US005358328A

United States Patent [19]

Inoue et al.

[11] Patent Number: 5,358,328

[45] Date of Patent: Oct. 25, 1994

[54] MIXING DEVICE

[75] Inventors: Takao Inoue, Setagaya; Yukihiro Omika, Suginami, both of Japan

[73] Assignee: Kajima Corporation, Tokyo, Japan

[21] Appl. No.: 32,704

[22] Filed: Mar. 17, 1993

Related U.S. Application Data

[63] Continuation of Ser. No. 795,023, Nov. 20, 1991.

[30] Foreign Application Priority Data

Nov. 21, 1990 [JP] Japan ..... 2-317004
Sep. 17, 1991 [JP] Japan ..... 3-236652

[51] Int. Cl.[5] ..... B28C 5/08

[52] U.S. Cl. ..... 366/65; 366/66; 366/266; 366/314

[58] Field of Search ..... 366/314, 205, 325, 327, 366/329, 330, 279, 292, 293, 319, 323, 65, 66, 266

[56] References Cited

U.S. PATENT DOCUMENTS

| | | | |
|---|---|---|---|
| 53,766 | 4/1866 | Allen | 366/292 |
| 58,337 | 9/1866 | Clift | 366/325 |
| 296,159 | 4/1884 | Gill | 366/325 |
| 529,937 | 11/1894 | Newhall | 366/325 |
| 1,709,516 | 4/1929 | Beatty | 366/325 |
| 3,374,989 | 3/1968 | Todtenhaupt . | |
| 4,361,405 | 11/1982 | Wedek et al. | 366/139 |

FOREIGN PATENT DOCUMENTS

| | | | |
|---|---|---|---|
| 950449 | 7/1974 | Canada | 366/196 |
| 0305576 | 3/1989 | European Pat. Off. . | |
| 1001663 | 1/1957 | Fed. Rep. of Germany | 366/325 |
| 1530719 | 7/1968 | France | 366/265 |
| 2121014 | 8/1972 | France . | |
| 2626787 | 8/1989 | France . | |
| 129294 | 1/1978 | German Democratic Rep. | 366/325 |
| 58-88126 | 5/1983 | Japan . | |
| 315164 | 7/1929 | United Kingdom | 366/325 |

*Primary Examiner*—David A. Scherbel
*Assistant Examiner*—Tony G. Soohoo
*Attorney, Agent, or Firm*—Wenderoth, Lind & Ponack

[57] ABSTRACT

By rotating mixing blade units having blades inclined in opposite directions, pulverulent materials such as cement can be effectively mixed with a liquid under the most suitable condition to produce a desirable mixture. The blades of the mixing blade units are in spaced opposed relation to each other and formed so as to have their front edges spaced at a larger distance than their rear edges relative to the direction of rotation, thereby to cause the parts of the mixture around the respective mixing blade units to come into collision with each other between the mixing blade units. A mixture of high quality in which the pulverulent materials are uniformly dispersed without being left in the form of immiscible lumps with the liquid can be obtained.

6 Claims, 8 Drawing Sheets

MIXING DEVICE

This application is a continuation of now abandoned application, Ser. No. 07/795,023, filed on Nov. 20, 1991.

BACKGROUND OF THE INVENTION

1. Field of the Invention

This invention relates to a device and method for mixing solid and liquid substances by suitable mixing action, and more particularly to a mixing device for mixing various kinds of pulverulent materials such as cement with a liquid such as water to obtain a suitable intimate mixture in which the pulverulent materials are uniformly dispersed in the mixture by rotating paired mixing blades so as to cause collisions of the particles of the pulverulent materials.

2. Description of the Prior Art

The quality of a mixture of various pulverulent materials and a liquid such as water depends on whether or not the particles of the pulverulent materials are uniformly dispersed in the resultantly obtained mixture and mixed completely with the liquid without being left in the form of immiscible lumps with the liquid. For example in the case of producing ready-mixed concrete, it is frequently difficult to produce concrete having satisfactory strength by mixing cement and aggregate with water to obtain cement paste in which the cement and aggregate are consistently mixed with the water. Therefore, there is now being widely adopted a step mixing method for producing concrete, in which cement and water are first mixed to make cement paste, and thereafter, aggregate is added to and mixed with the cement paste thus made.

One mixing device for carrying out the step mixing method for making such cement paste has been proposed by Japanese Patent Publication SHO 61-7928(B). In this conventional mixing device, raw materials such as water and cement are admitted one into either end portion of a mixing drum and forcibly introduced into a pressure chamber located at the center of the mixing drum by driving a screw to mingle the raw materials and obtain cement paste, and then, the cement paste thus obtained is fed out at a high rate of speed through a contracted path to impart a shearing force thereto.

The pulverulent particles of raw materials to be mixed tend to remain in a resultantly obtained mixture such as cement paste in the form of immiscible lumps in water, which lumps accommodate air between the pulverulent particles in such a state that the water brings about surface tension in the mixture. Therefore, fine air bubbles in the lumps of the pulverulent materials are held in the mixture by the liquid film crosslinking effect. Although there is a case that the pulverulent particles are electrostatically joined with one another, the coherence of the pulverulent particles joined electrostatically is weaker than the coherence caused by the liquid film crosslinking effect. However, in any case, the lumps of the pulverulent materials which are first brought about in the mixture cannot easily be broken merely by driving the screw used in the aforenoted conventional mixing device, because the fine air bubbles in the lumps of the pulverulent materials possibly serve as a cushion.

Furthermore, in the conventional mixing device noted above, heavy particles of the pulverulent materials in the mixture precipitate to the bottom of the mixing drum because of the difference in specific gravity of the particles. Therefore, the shearing force imparted to the cement paste occurs only in the contracted path in the mixing drum, but has no effect on the pulverulent particles precipitated to the bottom of the mixing drum.

As described above, the lumps of the pulverulent materials can not be broken effectively by the prior art apparatus including the conventional mixing device as noted above.

The inventors of the present invention have carried on various studies of an energy introducing method for effectively breaking and uniformly dispersing lumps of pulverulent particles in the mixture.

From the results of their studies, it was found that the finer the pulverulent particle to be mixed with a liquid having surface tension is, the larger the cohesion thereof becomes. To be more specific, the pulverulent particles such as cement generally have a diameter of the order of about 10 μm to several ten μm, and such fine particles tend to gather and agglomerate to form a lump in a liquid. Therefore, by the conventional mixing device which acts to mechanically mix the pulverulent materials with a rotating blade or one set of blades in a mixer container, a kinetic energy sufficient to break down the lumps of the pulverulent particles cannot be produced. That is to say, it is required to impart the energy directly to the lumps of the pulverulent particles in order to consistently mix the pulverulent particles with water. Further, the study made by the inventors reveals that the pulverulent particles can be dispersed uniformly in a liquid by causing collision of the particles by utilization of the difference in inertial mass between the pulverulent particles, and therefore, it is desirable to cause the pulverulent particles to collide head-on with one another.

OBJECT OF THE INVENTION

The present invention was made on the basis of the knowledge described above. Accordingly it is an object of the present invention is to provide a mixing device and mixing method capable of mixing pulverulent materials such as cement with a liquid under the most suitable condition to produce a desired mixture in which the pulverulent materials are uniformly dispersed without being left in the form of immiscible lumps in the liquid.

SUMMARY OF THE INVENTION

To attain the object described above according to the present invention there is provided a mixing device comprising a mixing container for materials to be mixed, and at least one pair of mixing blade units having blades extending radially outward and disposed vertically opposite to each other on the bottom of the mixing container and spaced at a distance.

Furthermore, the present invention provides a method for mixing pulverulent materials with a liquid to produce a mixture, comprising placing the pulverulent materials with the liquid into a mixing container, rotating, at a high speed, mixing blade units having blades radially extending outward, which mixing blade units are rotatably disposed vertically opposite to each other on the bottom of the container. Thus, the mixture around the respective mixing blade units come into collision by the high-speed rotation of said mixing blade units.

The mixing blade units are rotated to produce propulsive forces in opposite directions so that the materials such as pulverulent substances and liquids around the respective mixing blade units are thrust against each other to come into collision with each other between the mixing blade units. The blades vertically opposite to each other of the mixing blade units are so formed that the distance between their front edges is larger than that between their rear edges relative to the direction of rotation.

By rotating the mixing blade units at a high speed, propulsive currents of the pulverulent materials around the respective mixing blade units are brought about in the opposite directions between the opposite blades of the mixing blade units, causing intense collisions of the pulverulent materials in the region behind the rear edges of the blades. Consequently, the pulverulent materials are dispersed uniformly in a mixture obtained resultantly without being left in the form of immiscible lumps in the liquid such as water.

Fine lumps of the pulverulent materials which are possibly left in the mixture are circulated along with the mixture in the mixing container by the rotating blades and repeatedly stirred so as to be broken into fine particles miscible with the liquid.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
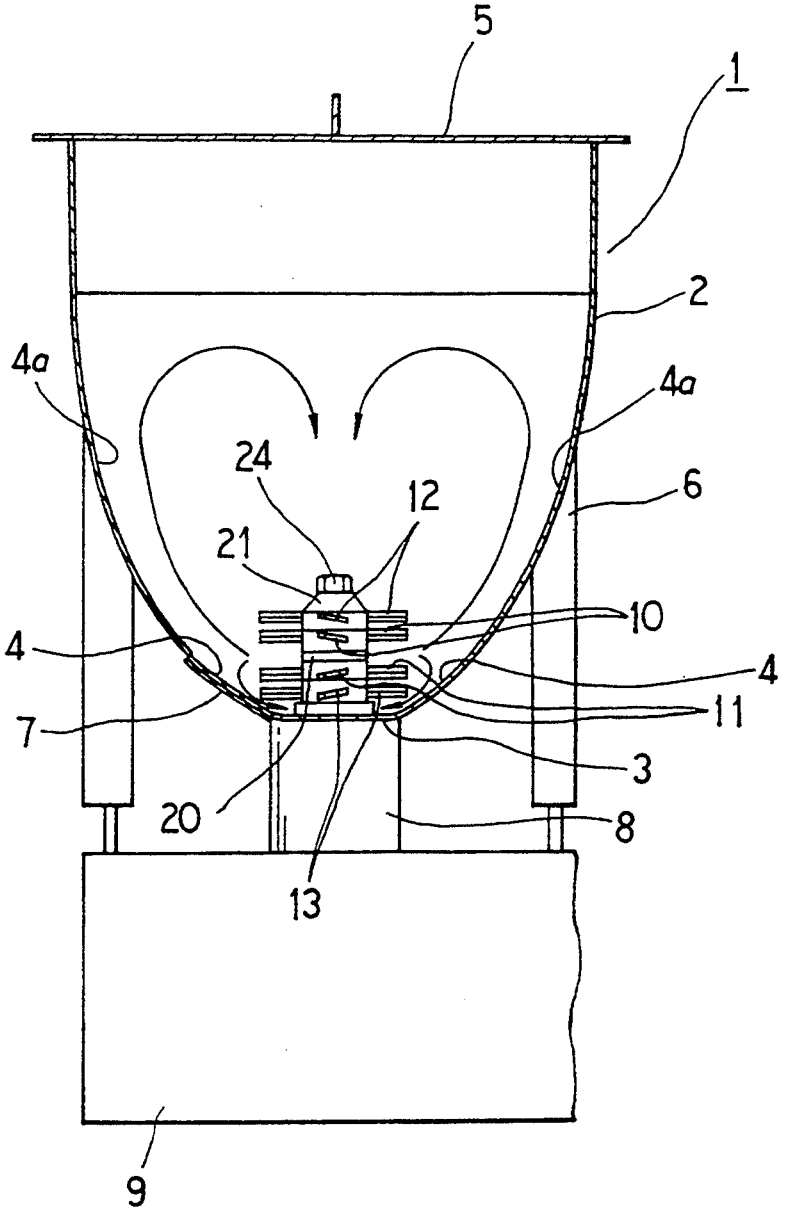
FIG. 1 is a schematic diagram showing a first embodiment of the mixing device according to this invention.
Figure 2:
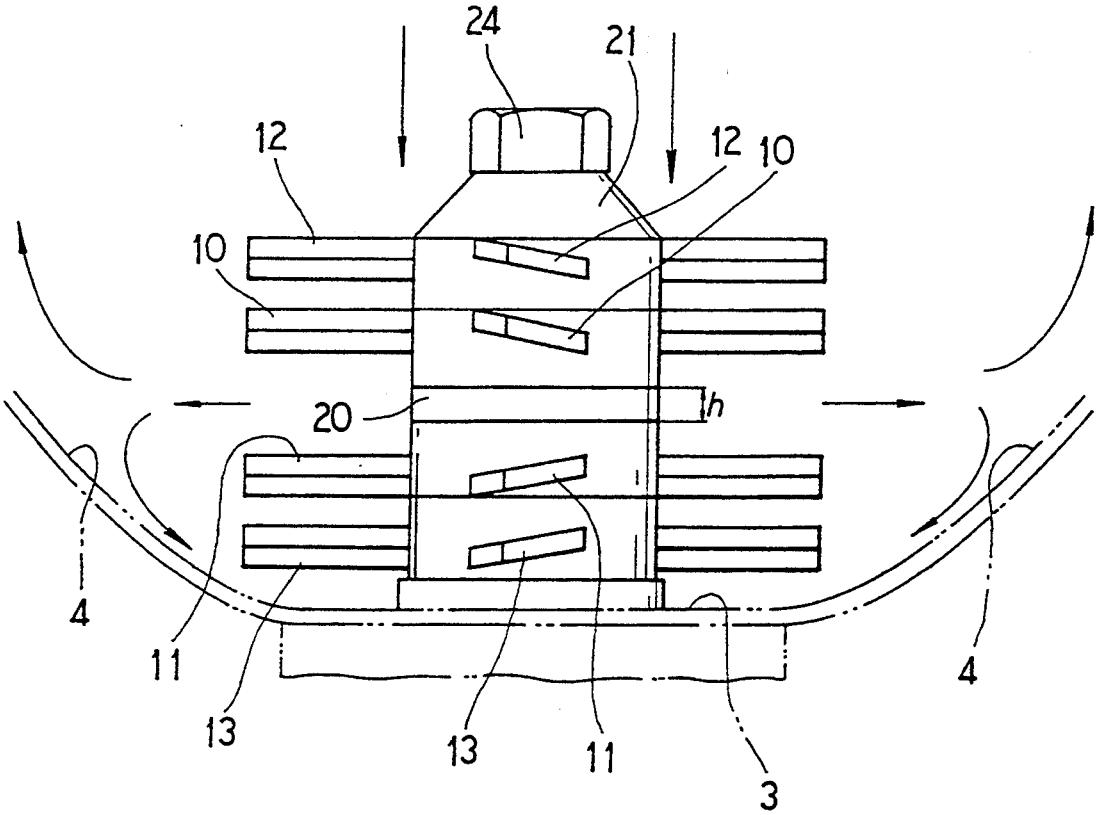
FIG. 2 is an explanatory diagram showing the principal portion of FIG. 1.
Figure 3:
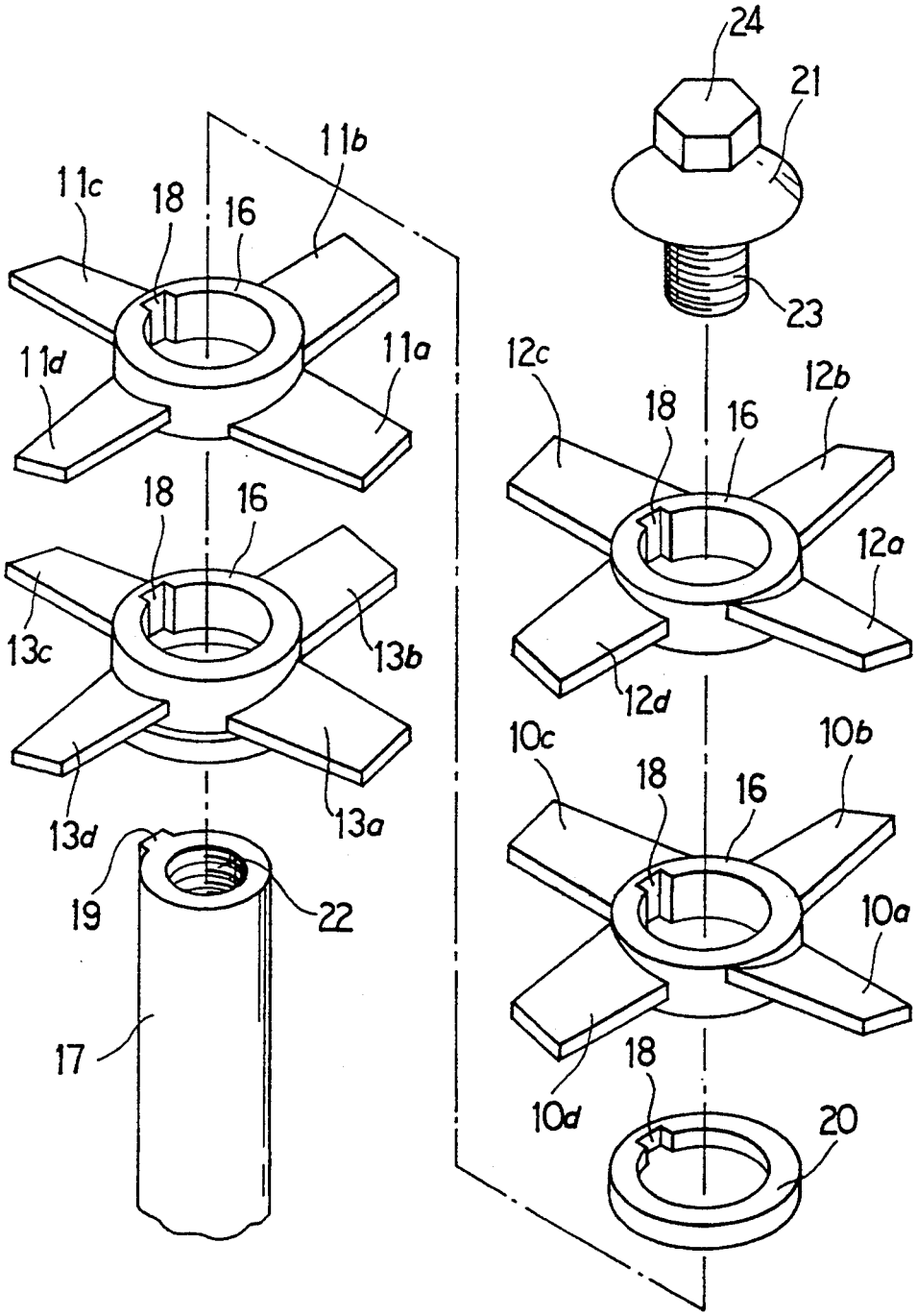
FIG. 3 is an exploded perspective view showing the principal portion of FIG.

The mixing device 1 illustrated in FIG. 1 through FIG. 3 as one example of this invention comprises a mixing container 2 for materials to be mixed, having a bottom 3 on which coaxial mixing blade units 10 and 11 are vertically spaced at a distance from each other, and auxiliary coaxial mixing blade units 12 and 13 are vertically spaced respectively at a distance from the respective mixing blade units 10 and 11 in a coaxial direction.

The mixing container 2 has an inner surface 4 shaped in an arc or parabola, in section, having a gradually decreasing inner diameter toward the bottom 3. That is, the inner surface 4 of the container 2 slants with slight curvature so as to permit the materials to be mixed in the container to flow from the horizontal direction in the upward direction along the slightly curved inner surface 4. The inner surface 4 is inclined at about 25° to about 70°, preferably about 30° to about 55°. The inner surface 4 leads to a circulating guide surface **4*a*** inclined sharply.

In the drawings, reference numeral 5 denotes a lid for covering an inlet of the container, 6 a supporting frame for the container, 7 an outlet of the container from which a mixture resultantly obtained is discharged, 8 a rotary shaft portion for the mixing blade units 10–13, and 9 a basal casing accommodating an electric motor (not shown) and other elements for driving the mixing blade units at a high speed.

The mixing blade units 10–13 have blades **10*a*–10*d*, 11*a*–11*d*, 12*a*–12*d*, and 13*a*–13*d* which are horizontally connected crosswise relative to one another and each shaped in a rectangle having a narrow width. The mixing blade units 10–13 are arranged in a four-layer stack so as to bring the blades of one of the units 10–13** in vertical spaced opposed relation to those of the other mixing blade units as illustrated.

The opposed blade mixing blade units 10 and 11 in the middle of the units 10–13 are rotated in the same direction so as to cause the materials around the blades of the respective units 10 and 11 to collide with materials from opposed blades therebetween. For example, the blades **10*a* and 11*a* of the respective mixing blade units 10 and 11 are opposed to each other so that the distance d1 between their front edges (intake side 14) is larger than the distance d2 between their rear edges (discharge side 15) relative to the direction of rotation indicated by the arrow R in FIG. 4. That is, in a case of blades formed of a thin plate having substantially equal thickness on the whole, the upper blade 10*a* is inclined downward from the front edge to the rear edge thereof relative to the direction of rotation, and the lower blade 11*a* is inclined upward. Namely, the upper and lower blades are inclined in substantially opposite directions. The blades 10*a*–10*d* and 11*a*–11*d*** are inclined at about 30°, preferably, in the range of about 5° to about 15°.

The upper and lower auxiliary mixing blade units 12 and 13 have blades **12*a*–12*d* and 13*a*–13*d* each inclined in the same direction as that in which the blades of the adjacent mixing blade unit 10 or 11 disposed in the middle are inclined. Namely, the blades 12*a*–12*d* of the upper auxiliary unit 12 are each inclined downward from the front edge to the rear edge thereof relative to the direction of rotation, and the blades 13*a*–13*d* of the lower auxiliary unit 13 are each inclined upward from the front edge to the rear edge. The blades 12*a*–12*d* and 13*a*–13*d* are inclined at a degree of about 30°, preferably, in the range of about 5° to about 15°, in the same manner as the middle mixing blade units 10 and 11**.

To be more specific, the mixing blade units 10–13 each may be formed by radially extending blades from a hub 16 fitted to a rotary shaft 17, as one example. In this case, each mixing blade unit is be engaged with the rotary shaft 17 by means of a key groove 18 and a key 19. Between the hubs 16 of the mixing blade units 10 and 11, there may be interposed a gap adjusting member 20 shaped in a ring having the same diameter as the hub 16. A plurality of gap adjusting members different in height may be provided so that the distance between the mixing blade units 10 and 11 can be selectively changed in accordance with the specific gravity and viscosity of the mixture to be dealt with by this mixing device, the rotational speed of the mixing blade units and other possible factors. By using gap adjusting members 20 of different heights, the mixture in the container can caused to properly flow properly and be sufficiently mixed. Thus, the mixture parts around the blades 10*a* and 11*a* are effectively propelled by the rotating blades and collide with each other in the region A1 and A2 behind the blades relative to the direction of rotation.

The mixing blade units 10–13 and the gap adjusting member 20 are fixed onto the rotary shaft 17 by a bolt as shown in FIG. 3. That is, the rotary shaft 17 is formed with a screw hole 22, and a fixing member 21 having a shank 23 and a bolt head 24 is used. By tightening up the shank 23 in the screw hole 22, the mixing blade units and gap adjusting member can be fixed.

Next, the operation of mixing pulverulent materials with a liquid by using the aforenoted mixing device according to this invention will be explained hereinafter.

Upon pouring the liquid such as water into the mixing container 2, the mixing blade units 10–13 are driven to rotate the blades 10*a*–10*d*, 11*a*–11*d*, 12*a*–12*d* and 13*a*–13*d* at a high speed so as to bring about a strong current of water. By the rotating blades 10*a*–10*d* and 11*a*–11*d*, upward and downward currents (f1) of water are formed, and then, collide with each other at the regions A1 and A2. Since the distance d1 at the intake side 14 is larger than the distance d2 at the discharge side 15, the water flowing into the space between the blades 10*a* and 11*a* through the intake side opening 14 is accelerated so as to be discharged backward through the discharge side opening 15 at a high speed.

Next, pulverulent materials such as cement and aggregate are added to the water in the mixing container 2. Since the fine particles of the pulverulent materials, if agglomerating densely, are immiscible with water, the pulverulent materials tend to remain in the form of numerous lumps in a resultantly obtained mixture containing the water. However, the mixture including the lumps of the pulverulent materials are sufficiently stirred by the rotating blades. Moreover, by rotating the mixing blade units at a high speed, the the parts of the mixture around the upper and lower mixing blade units 10 and 11 are thrust downward and upward and collide with each other under intense force at the regions A1 and A2 to break the lumps of the pulverulent materials into fine particles miscible with water. The fine particles of the pulverulent materials are consequently dispersed uniformly in the mixture.

Figure 4:
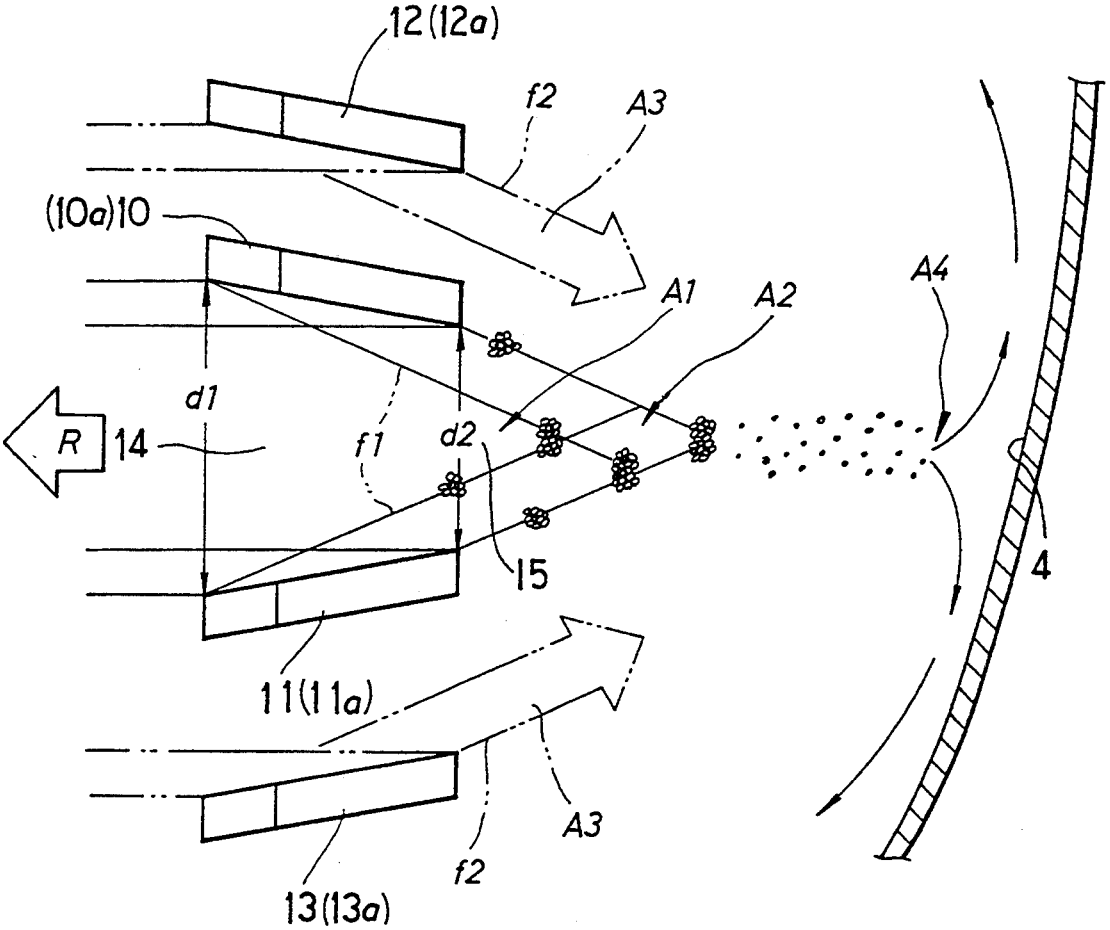
FIG. 4 and FIG. 5 are schematic perspective and plan views showing the principal portion and for explaining the mixing principle of this invention.
Figure 5:
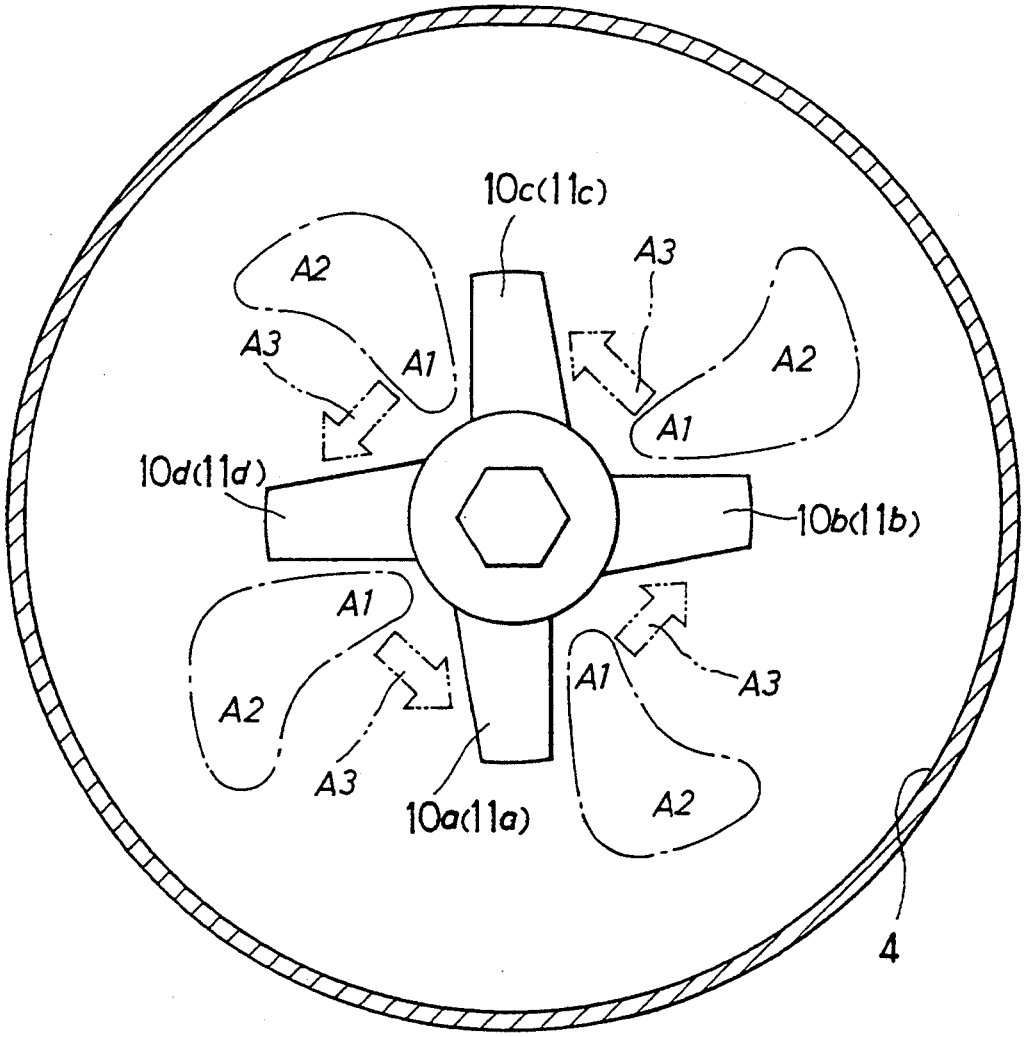

To be more exact, the collisions of the lumps of the pulverulent materials are first caused in the region A1 behind the rotating blades 10*a*–10*d* and 11*a*–11*d* and further developed to the region A2 as shown in FIGS. 4 and 5. Thus, the lumps of the pulverulent materials will be completely broken up.

The pulverulent materials reach the region A4 separated from the inner wall surface 4 of the container 2 while being dispersed in the mixture and are split in two streams upward and downward along the inner wall surface 4 to be circulated by convection.

Simultaneously the parts of the mixture around the blades 12*a*–12*d* and 13*a*–13*d* of the upper and lower auxiliary mixing blade units 12 and 13 are propelled by the rotating blades 12*a*–12*d* and 13*a*–13*d* toward the region A2 or A4 via the region A3 to form currents f2. The currents f2 of the mixture also contribute toward breaking up the lumps of the pulverulent materials in the mixture.

The mixing blade units are rotated at such a rate that the outer edge of the rotating blade moves at a circumferential speed of about 2 meters per second to about 70 meters per second; preferably about 8 meters per second to about 55 meters per second. In this range of the circumferential speed, sufficient difference in inertial mass between the pulverulent particles contained in the mixture can be acquired.

To confirm the performance of the mixing device of this invention, experiments were conducted in the form of a flow point test and a bleeding test. In the experiments, mixture paste obtained by the mixing device of this invention was compared with that by a conventional forced pan-type mixing device. It is evident from the results of the experiments shown in TABLE 1 below that high flow property of the mixture paste in the mixing container of the present invention can be provided resulting in production of a mixture of high quality according to the present invention.

TABLE 1

(Comparison on mixture paste)
[Conditions] Water-cement ratio = 40%
Ordinary Portland cement only used.

| Mixer | Flow-down Time in Funnel | Bleeding Amount |
|---|---|---|
| Present Invention | 14.2 sec | 1.4% |
| Conventional Mixer | 17.2–20.0 sec | 2.0% |

Further, the superiority of the mixing device according to this invention in comparison with the conventional forced pan-type mixing device was proved experimentally as is obvious from TABLE 2 below.

TABLE 2

| | Mixer of Present Invention | | | Conventional Forced Pan Mixer | | |
|---|---|---|---|---|---|---|
| Water-Cement Ratio % | 30 | 35 | 40 | 30 | 35 | 40 |
| Aggregate-Cement Ratio % | 41.8 | 44.1 | 45.7 | 41.8 | 44.1 | 45.7 |
| Unit Weight (kg/m) | | | | | | |
| Water | 170 | 170 | 170 | 170 | 170 | 170 |
| Cement | 567 | 486 | 425 | 567 | 486 | 425 |
| Fine Aggregate | 694 | 760 | 813 | 694 | 760 | 813 |
| Coarse Aggregate (*1) | 969 | 969 | 969 | 969 | 969 | 969 |
| RHEOBUILD SP-9HS (CX %) | 1.3 | 0.9 | 1.0 | 1.7 | 1.5 | 1.4 |
| Slump & Flow (cm) | 21.5 | 20.0 | 20.0 | 18.0 | 18.0 | 20.0 |
| | 35 × 35 | 31 × 31 | 33 × 32 | 30 × 28 | 28 × 28 | 33 × 32 |
| Slump after 20 min. | 23.0 | 16.5 | 20.0 | 19.5 | 18.0 | 19.0 |

TABLE 2-continued

| | Mixer of Present Invention | | | Conventional Forced Pan Mixer | | |
|---|---|---|---|---|---|---|
| (cm) (*2) | 39 × 38 | 28 × 26 | 33 × 28 | 33 × 28 | 29 × 28 | 28 × 28 |

[Conditions] Mixing time was constant. Compressive strength was kept equal.
*1 . . . Bulk capacity of coarse aggregate was 0.60 $m/m^3$.
*2 . . . Slump obtained 20 minutes after completion of mixing was measured with mixed concrete maintained at rest.

Figure 6:
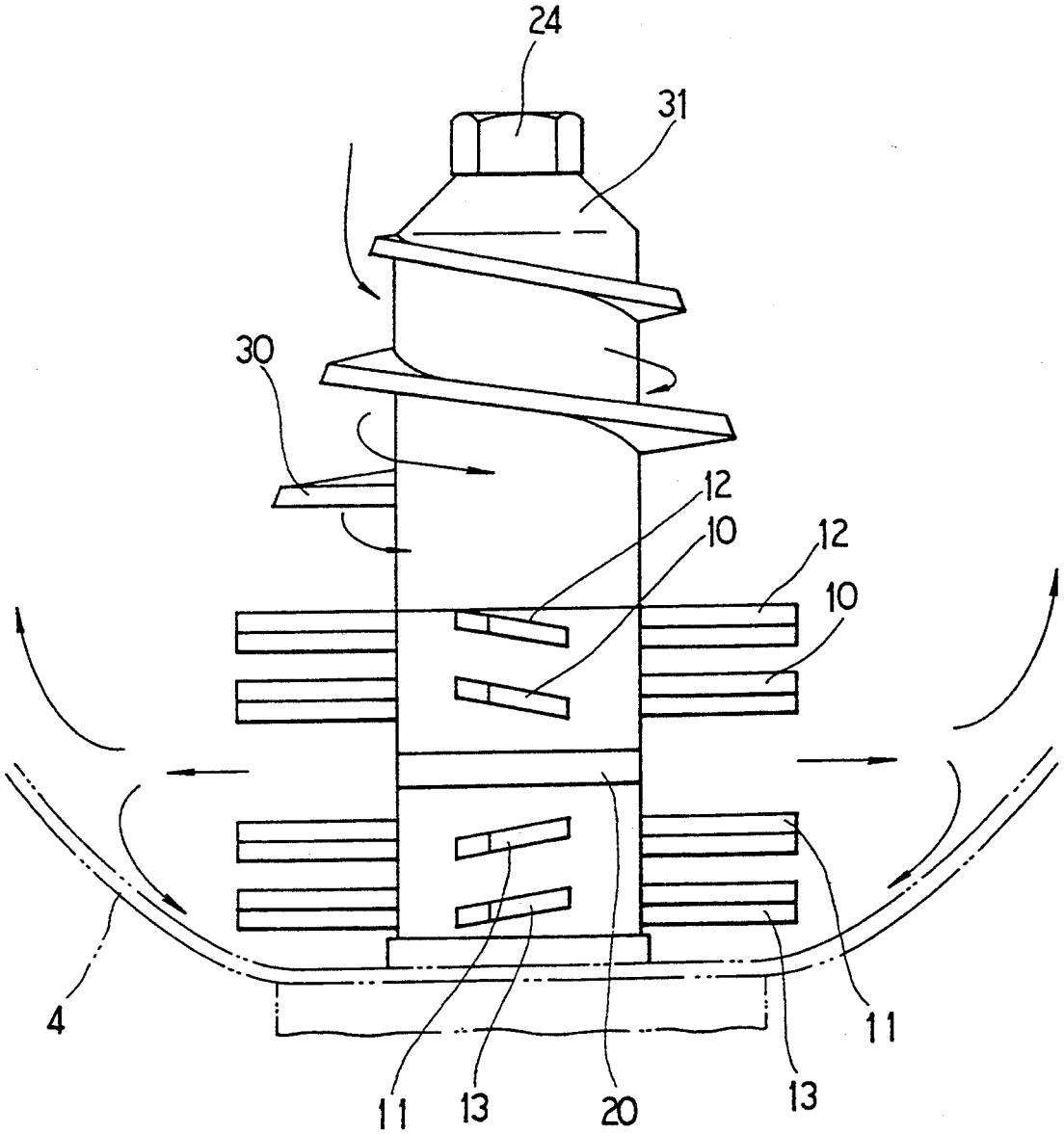
FIG. 6 is a schematic side view of a second embodiment of this invention.
Figure 7:
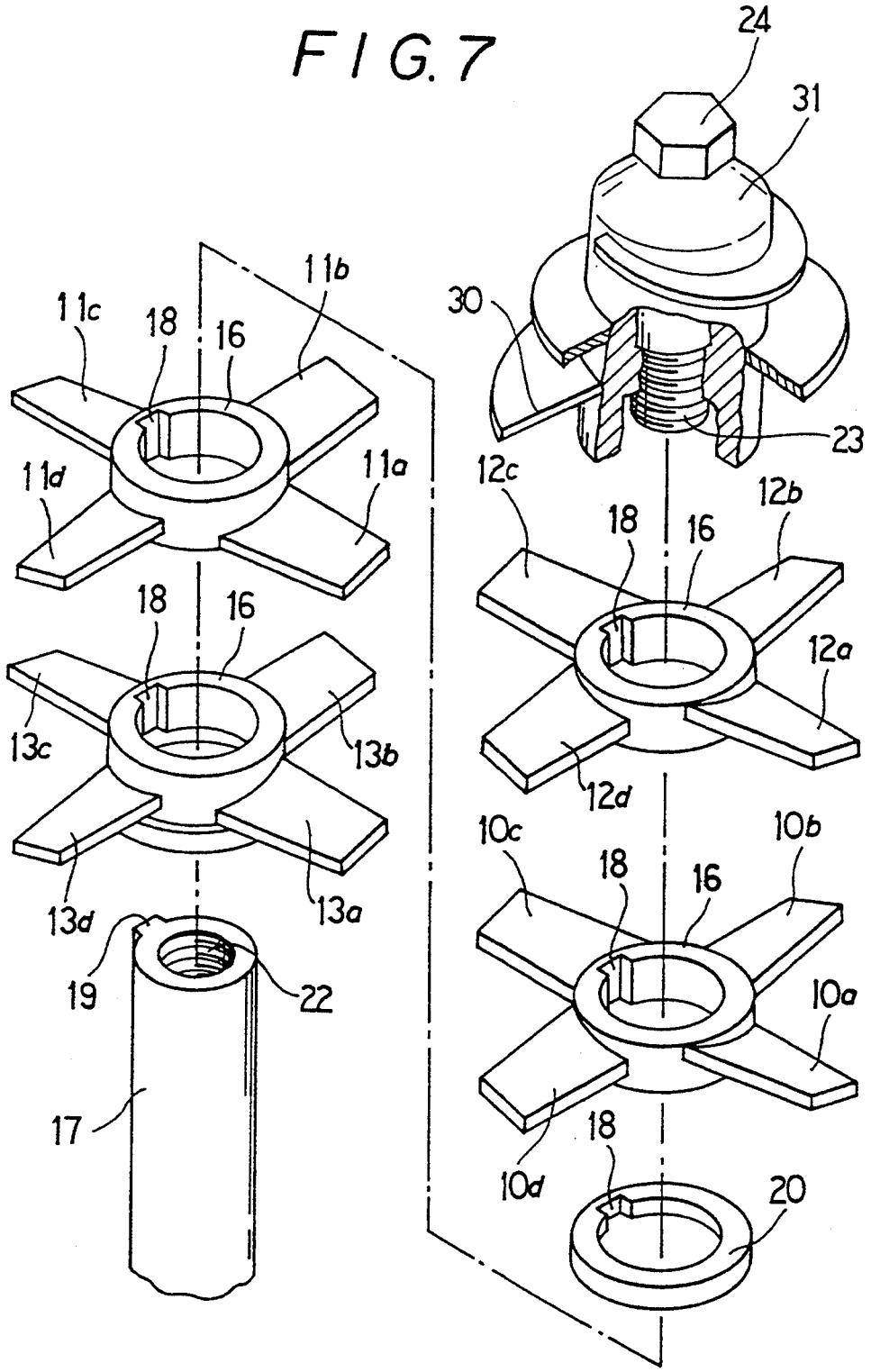
FIG. 7 is an exploded perspective view showing the principal portion of FIG. 6.

Next, the second embodiment of the mixing device according to this invention will be described with reference to FIGS. 6 and 7.

This mixing device has a spiral blade 30 for promoting circulation of the mixture in the container 2 in addition to mixing blade units 10, 11, 12 and 13 similarly to the foregoing embodiment. The spiral blade 30 is formed on the circumferential surface of a fixing member 31 for fixing the mixing blade units 10–13 onto the rotary shaft 17. In this embodiment, the elements indicated by like reference numerals correspond to those of the first embodiment have analogous structures and functions to those of the first embodiment and will not be described in detail again.

This mixing device having the spiral blade 30 enables even pulverulent materials having high viscosity such as cement mortar to be effectively circulated and mixed in the container.

Figure 8:
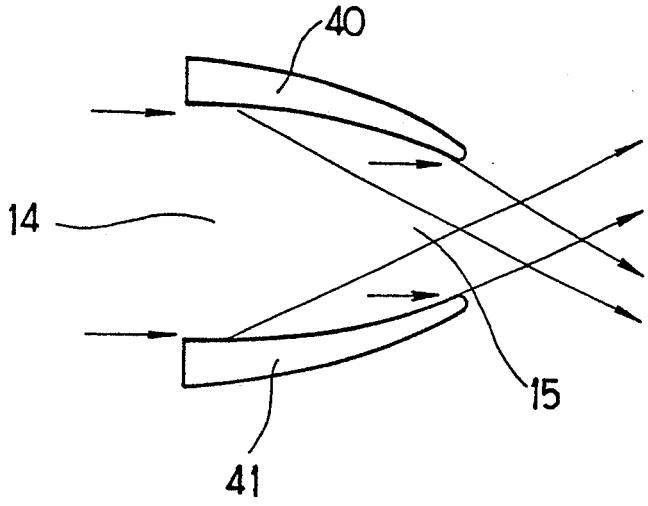
FIG. 8 is an explanatory view of a third embodiment of this invention.

FIG. 8 illustrates the third embodiment having a modified blade structure. In this embodiment, there are used vertically spaced opposed blades 40, 41 which are curved inwardly toward each other like a bird bill when viewed from the side.

The curved blades 40, 41 are effective particularly for pulverulent materials of fine or light particles. To the curved blades 40, 41 there may be imparted vibration to promote mixing of the pulverulent materials in the container.

Figure 9:
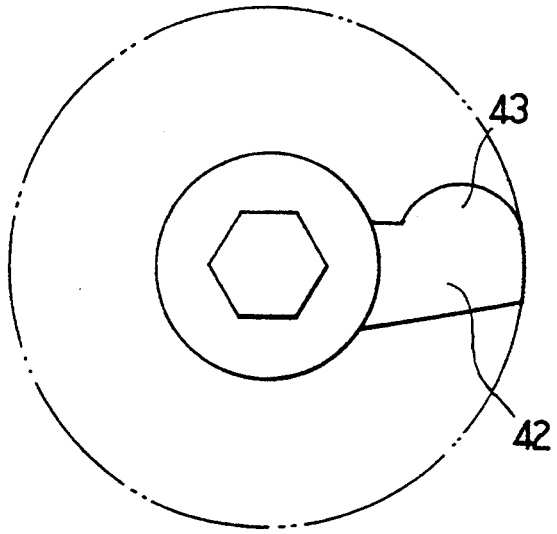
FIG. 9 is an explanatory view of a fourth embodiment of this invention.

As shown in FIG. 9 as the fourth embodiment of this invention, each blade 42 of the respective mixing blade units is provided with an expansion portion 43 extending backward from the rear edge of the blade relative to the direction of rotation. This blade 42 can produce a more strong current of pulverulent materials in the container. One mixing blade unit has plural blades 42 as indicated by the chain line in FIG. 9. The number of the blades 42 may be arbitrarily decided, e.g. three, four, five or more.

Though the foregoing explanation is made as to the mixing device used particularly for cement paste, this invention can be adapted for mixing various pulverulent materials regardless of the size of the particles and the viscosity of the mixture by arbitrarily determining the rotational speed and shape of the blades and the shape of the container in compliance with numerous uses. The mixing device of this invention can be applied practically in its modified form to various fields such as foods, medicines, metals, ceramics, plastics, livestock feed and so on.

As is apparent from the foregoing, according to the mixing device and method of the present invention, various sorts of pulverulent materials such as cement can be effectively mixed with a liquid under the most suitable condition to produce a desirable mixture in which the pulverulent materials are uniformly dispersed without being left in the form of immiscible lumps in the liquid.

As many apparently widely different embodiments of this invention may be made without departing from the spirit and scope thereof, it is to be understood that the invention is not limited to the specific embodiments thereof except as defined in the appended claims.

What is claimed is:

1. A mixing device for mixing cement, aggregate and water together, comprising:

a mixing container for holding materials to be mixed and having a bottom;

a rotary shaft extending vertically upwardly into said mixing container from said bottom;

at least one upper mixing blade unit having a hub mounted on said rotary shaft for rotation therewith and having a plurality of radially extending horizontal slender, rectangular, flat upper blades thereon, said upper blades being in a planar space extending perpendicular to said rotary shaft, each said upper blade being inclined downward from a front edge, relative to a direction of rotation of said rotary shaft, to a rear edge, relative to the direction of rotation of said rotary shaft;

at least one lower mixing blade unit having a hub mounted on said shaft below said upper mixing blade unit for rotation with said rotary shaft and having a plurality of radially extending horizontal slender, rectangular, flat lower blades thereon the same in number as the number of upper blades, said lower blades being in a planar space extending perpendicular to said rotary shaft, each said lower blade being inclined upward from a front edge, relative to the direction of rotation of said rotary shaft, to a rear edge, relative to the direction of rotation of said rotary shaft;

each of said upper blades being in vertical spaced opposed relationship to a corresponding one of said lower blades and the spaces between said upper blades and said lower blades being unobstructed throughout the circumferential space between said blade units, the opposed upper and lower blades being sufficiently closely spaced to force particles of the cement and aggregate toward each other for causing the particles to collide when said rotary shaft is rotated at a predetermined speed;

said mixing container further having an annular side wall curving upwardly and outwardly from said bottom to provide an upwardly and outwardly expanding space radially outwardly of the radially outer ends of said upper and lower blades; whereby materials being mixed in said container are guided between said front edges of said upper and lower blades and then along said upper and lower blades and between said rear edges of said upper and lower blades so as to be caused to flow rearwardly and radially outwardly of said blades so as to come into collision with each other rearwardly of said blades and in said upwardly and outwardly expanding space when said upper and lower blade units rotate in said direction of rotation and the materials being mixed are then recirculated along said annular side wall to said upper and lower mixing blade units.

2. The mixing device according to claim 1 further comprising a gap adjusting member interposed between said mixing blade units.

3. The mixing device according to claim 1 wherein said mixing container has an inner surface shaped in an arc or parabola, in section, having a gradually decreasing inner diameter toward the bottom of said container, which inner surface slants with slight curvature so as to permit the materials in said container to flow from the horizontal direction to the upward direction along said inner surface.

4. The mixing device according to claim 1 further comprising a spiral blade for circulating the mixture in said container, said spiral blade being disposed on said mixing blade units.

5. A mixing device as claimed in claim 1 further comprising at least one further upper mixing blade unit on said rotary shaft above said upper mixing blade unit and having a plurality of further upper blades thereon the same in number as the number of upper mixing blades and inclined in the same direction and in a similar planar space with the further upper mixing blades in vertical spaced opposed relation to respective upper mixing blades and the space between said further upper mixing blades and said upper mixing blades being unobstructed throughout the circumferential space between said upper blade unit and said further upper blade unit, and at least one further lower mixing blade unit on said rotary shaft below said lower mixing blade unit and having a plurality of further lower mixing blades the same in number as the number of lower mixing blades and inclined in the same direction and in a similar planar space with the further lower mixing blades in vertical spaced opposed relation to respective lower mixing blades and the space between said said further lower mixing blades and said lower mixing blades being unobstructed throughout the circumferential space between said lower blade unit and said further lower blade unit.

6. A mixing device as claimed in claim 1 wherein said upper and lower blades are each inclined at an angle of from about 5° to about 15° to a horizontal plane through said mixing blades and perpendicular to said rotary shaft.

* * * * *